US008915400B2

(12) United States Patent
Muller

(10) Patent No.: US 8,915,400 B2
(45) Date of Patent: Dec. 23, 2014

(54) FLUID DISPENSER

(75) Inventor: Patrick Muller, Saint Aubin sur Gaillon (FR)

(73) Assignee: Aptar France SAS, Le Neubourg (FR)

( * ) Notice: Subject to any disclaimer, the term of this patent is extended or adjusted under 35 U.S.C. 154(b) by 10 days.

(21) Appl. No.: 13/563,200

(22) Filed: Jul. 31, 2012

(65) Prior Publication Data

US 2013/0032610 A1 Feb. 7, 2013

Related U.S. Application Data

(60) Provisional application No. 61/533,995, filed on Sep. 13, 2011.

(30) Foreign Application Priority Data

Aug. 1, 2011 (FR) ..... 11 57018

(51) Int. Cl.

| | |
|---|---|
| ***B65D 5/66*** | (2006.01) |
| ***F21V 33/00*** | (2006.01) |
| ***B05B 11/00*** | (2006.01) |
| ***B65D 51/24*** | (2006.01) |
| *F21V 23/00* | (2006.01) |
| *B05B 15/00* | (2006.01) |
| *F21S 9/02* | (2006.01) |
| *F21Y 101/02* | (2006.01) |

(52) U.S. Cl.

CPC ..... *B05B 11/3001* (2013.01); *F21V 23/005* (2013.01); *F21V 33/0004* (2013.01); *B05B 15/00* (2013.01); *B65D 51/248* (2013.01); *B05B 11/3047* (2013.01); *F21S 9/02* (2013.01); *F21Y 2101/02* (2013.01)

USPC ..... 222/113; 222/158; 222/321.7; 222/402.1

(58) Field of Classification Search

USPC ..... 222/321.9, 321.7, 383.1, 380, 113, 222/154–159, 377, 602, 660, 402.1; 40/406, 407; 73/293, 330, 334, 327

See application file for complete search history.

(56) References Cited

U.S. PATENT DOCUMENTS

| | | | | |
|---|---|---|---|---|
| 2,442,599 | A * | 6/1948 | Herrick, Jr. et al. | 251/76 |
| 3,068,777 | A * | 12/1962 | Pedalino | 99/305 |
| 6,293,685 | B1 * | 9/2001 | Polkow | 362/253 |
| 7,451,899 | B2 * | 11/2008 | de Pous | 222/321.9 |
| 8,210,395 | B1 * | 7/2012 | Morris | 222/113 |
| 8,528,790 | B2 * | 9/2013 | Wegelin | 222/192 |
| 2006/0250795 | A1 * | 11/2006 | Langone | 362/253 |
| 2010/0213212 | A1 * | 8/2010 | Custodis et al. | 222/113 |

FOREIGN PATENT DOCUMENTS

| | | |
|---|---|---|
| FR | 2 908 502 A1 | 5/2008 |
| WO | 2007/035516 A2 | 3/2007 |
| WO | 2008/020100 A1 | 2/2008 |

* cited by examiner

*Primary Examiner* — Frederick C Nicolas
*Assistant Examiner* — Bob Zadeh
(74) *Attorney, Agent, or Firm* — Sughrue Mion, PLLC

(57) ABSTRACT

A fluid dispenser having a fluid reservoir including a shoulder from which there extends a neck defining an opening; and a dispenser member, such as a pump or a valve, including a body that is held in stationary manner in the opening of the reservoir. At least one source of radiation is disposed in the proximity of the neck, outside the neck, above the shoulder.

10 Claims, 2 Drawing Sheets

FLUID DISPENSER

CROSS REFERENCE TO RELATED APPLICATION

This application claims the benefit under 35 U.S.C. §119(e) of U.S. provisional patent application Ser. No. 61/533,995, filed Sep.13, 2011, and priority under 35 U.S.C. §119(a)-(d) of French patent application No. FR-11 57018, filed Aug. 1, 2011, the foregoing applications are incorporated herein by reference.

TECHNICAL FIELD

The present invention relates to a fluid dispenser comprising a reservoir having a neck defining an opening, and a dispenser member, such as a pump or a valve, having a body that is held in stationary manner in the opening of the reservoir. Advantageous fields of application of the present invention are the fields of perfumery, cosmetics, or even pharmacy.

BACKGROUND OF THE INVENTION

In the prior art, US document No. 2010/0213212 is already known, which describes a fluid dispenser including a plurality of light sources that are oriented towards the reservoir or towards the dispensed fluid. The light sources are configured to be activated for a predetermined period of time when the dispenser is actuated. The fluid is dispensed by means of a piezoelectric, thermoelectric, or even electrostatic generator. Consequently, the dispenser is entirely electronic, given that the fluid is not dispensed by means of a conventional valve or a pump that is actuated manually by means of a pusher serving to vary the volume of a fluid chamber defined inside the body of the pump or of the valve. The provision of light sources associated with a power generator makes that dispenser an assembly that is entirely electrical.

In the prior art, document WO 2005/095003 is also known, which describes a dispenser head incorporating a light source that is disposed on the bottom face of the head so as to illuminate the container and its contents. That document does not indicate how the dispenser head is associated with a dispenser member of the pump or valve type that makes it possible to take and dispense the fluid.

Document FR 2 927 068 is also known, which describes a dispenser device incorporating irradiation means that are disposed on the fluid passage in such a manner as to irradiate the fluid. More precisely, the irradiation means are disposed in a pusher in the proximity of the dispenser orifice. The purpose of the irradiation is to modify the properties of the dispensed fluid.

Those prior-art documents describe concepts that are relatively theoretical, the practical implementation of which turns out to be extremely complicated.

FR2908502 and WO2007/035516 are also known: they describe dispensers comprising a source of radiation received within a decorative hoop, around the reservoir neck, above the reservoir shoulder. These hoops are especially designed for housing the source of radiation.

BRIEF SUMMARY OF THE INVENTION

An object of the present invention is to remedy the above-mentioned drawbacks of the prior art by defining a fluid dispenser that incorporates a source of radiation, of irradiation, or of light in a manner that is very practical and that is extremely simple to implement. An object of the present invention is to associate, in ingenious and realistic manner, a source of radiation with a conventional dispenser member of the pump or valve type.

To achieve these objects, the present invention provides a fluid dispenser comprising: a fluid reservoir including a shoulder from which there extends a neck defining an opening, and a dispenser member, such as a pump or a valve, including a body that is held in stationary manner in the opening of the reservoir by fastener means that include a fastener skirt that engages the neck, at least one source of radiation being disposed in the proximity of the neck, outside said neck, above the shoulder, the source of radiation being mounted in a collar that extends around the neck, above the shoulder and below the fastener skirt.

Preferably, the source of radiation is disposed axially at the height of the neck. The source of radiation is thus disposed at a location of the dispenser that enables it to radiate equally well towards the container, towards the neck of the container, or towards the fastener means. Conventionally, there are no vital components of the dispenser or of the dispenser member situated above the shoulder of the reservoir. In general, the fastener means include an integrated hoop or a fitted hoop that extends so as to be in contact with the shoulder in order to mask the bottom portion of the neck. In the invention, the source of radiation may be disposed inside the hoop or just below it, i.e. between the shoulder and the bottom portion of the hoop. By way of example, it is possible to provide a plurality of sources of radiation that are distributed around the neck of the reservoir.

In an embodiment, the collar is secured to fastener means, e.g. by snap-fastening on the fastener skirt.

In an extremely practical embodiment, the collar comprises: a support ring on which the source of radiation is mounted; an assembly sleeve supporting the ring and advantageously connected to the fastener means; and an outer fairing that surrounds the ring, the sleeve, and the source of radiation; the sleeve and the fairing advantageously being made as a single part.

Advantageously, the fairing is transparent or translucent to the radiation from the source of radiation. The collar may be a separate piece fitted around the neck or integrated with the fastener means.

In another aspect of the invention, the source of radiation comprises a light-emitting diode (LED) that is associated with a power-supply battery and possibly with an electronic circuit. The LED, the battery, and the circuit may be mounted in the collar.

In order to enable the radiation from the source to diffuse outside the collar, provision is made for the reservoir, the fastener means, and/or the dispenser member to be transparent or translucent to the radiation from the source of radiation. By way of example, it is possible to envisage that the radiation from the source passes through the neck and the body of the dispenser member in such a manner as to irradiate the fluid present inside the dispenser member.

The spirit of the invention resides in the apt, easy, and safe positioning of one or more sources of radiation outside the reservoir, around the neck, above the shoulder.

BRIEF DESCRIPTION OF THE DRAWINGS

The invention is described more fully below with reference to the accompanying drawings, which show several embodiments of the invention by way of non-limiting example.

In the figures.

DETAILED DESCRIPTION

Figure 1:
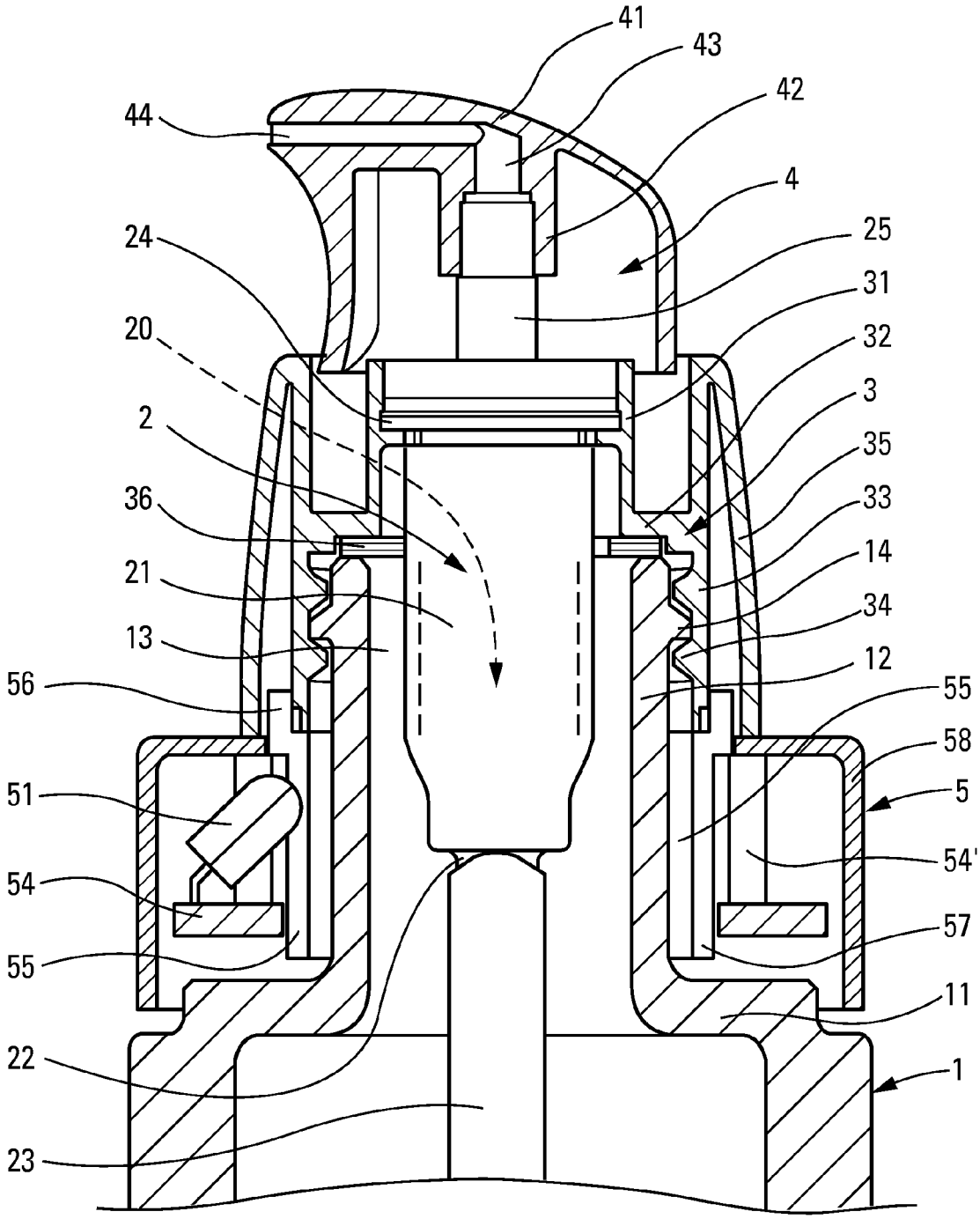
FIG. 1 is a vertical-section view through a fluid dispenser in an embodiment of the invention.
Figure 2:
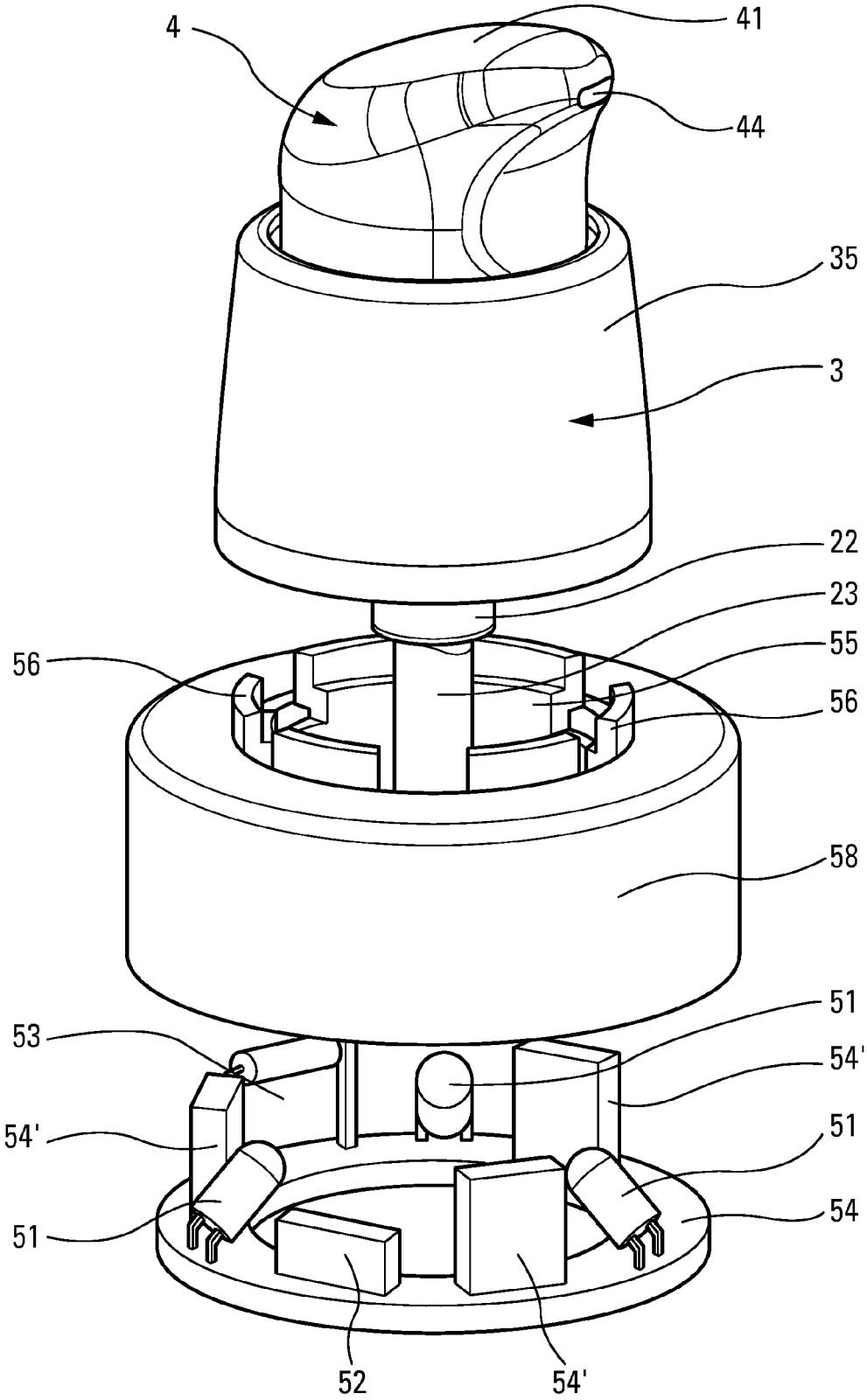
FIG. 2 is an exploded view of the FIG. 1 dispenser.

The dispenser of the invention comprises the following component elements, namely: a reservoir 1, a dispenser member 2; fastener means 3; a pusher 4; and a collar 5.

The container 1 includes a shoulder 11 from which there projects a neck 12 defining an opening 13 via which the inside of the container communicates with the outside. Furthermore, the neck forms an external screw thread 14 that serves to fasten the dispenser member 2, as described below. Some or all of the container may be transparent or translucent.

The present invention applies to all kinds of dispenser member, such as pumps or valves. Consequently, the dispenser member 2 shown in the figures can be either a pump or a valve. The dispenser member 2 includes a body 21 defining an inlet 22 to which a dip tube 23 may be connected, and which extends inside the container 1 down to its bottom wall. At its end remote from the inlet 22, the body 21 includes an outwardly-projecting rim 24. The dispenser member also comprises an actuator rod 25 that is mounted to move downwards and upwards inside the body 21 that forms a fluid chamber 20. The actuator rod 25 drives an element (not shown), which may be a piston for a pump, or a valve member for a valve, and which has the purpose of causing the volume of the fluid chamber 20 to vary. Between two actuations of the rod 25, the chamber 20 is continuously full of fluid.

The pusher 4 is mounted on the top end of the actuator rod 25. In the embodiment shown, the pusher forms a bearing surface 41, a connection tube 42 that is engaged on the rod 25, and an internal duct 43 that connects a dispenser orifice 44, e.g. in the form of a nozzle. The operation of such a dispenser member is very simple and well known: it suffices to press on the bearing surface 41 so as to move the actuator rod 25 in the body 21, thereby dispensing an optionally-measured quantity of fluid through the actuator rod 25 to the dispenser orifice 44.

In this embodiment, the fastener means 3 are in the form of a fastener ring 3 that forms both a reception housing 31 for receiving the rim 24 of the body 21, and a threaded skirt 33 that is in engagement with the thread 14 of the neck. The housing is connected to the skirt via an annular disk 32. The ring 3 also forms an outer hoop 35 that extends around the skirt 33. To achieve sealed fastening on the neck, the fastener means advantageously include a neck gasket 36 for compressing between the disk 32 and the neck 12. This is a non-limiting embodiment, since the fastener means may also be in the form of a ring for crimping or snap-fastening, or even a ring having a sealing lip (without a neck gasket). The particular form of the fastener means is not critical in the present invention.

This is entirely conventional for a pump or a valve in the fields of cosmetics, perfumery, or even pharmacy.

In the invention, the dispenser includes one or more sources of radiation 51 that is/are capable of emitting radiation in a certain direction. The source of radiation 51 is positioned outside the container in the direct proximity of the neck 12, above the shoulder 11. The body 21 of the dispenser member may extend at the same axial height as the source of radiation. The source of radiation 51 may emit in the visible spectrum in such a manner as to constitute a light source. It may also emit in an invisible spectrum. By way of example, the purpose of the radiation from the source may be to illuminate, modify, stabilize, sterilize, and/or decontaminate the components and/or the fluid. By way of example, the light source 51 may radiate through the neck 12 and the body 21 of the dispenser member in such a manner as to irradiate or illuminate the contents of the fluid chamber 20. Naturally, in order to do that, it is necessary for the body 21 to be made out of a material that is transparent or translucent to the radiation from the source 51. By way of example, the radiation emitted by the source may have an effect on the fluid stored in the chamber 20: the radiation may modify the properties of the fluid, or may even increase its stability. The radiation emitted by the source 51 may merely have an illumination effect, so as to illuminate the dispenser member 2. It is also possible to imagine that the source of radiation 51 radiates through the neck 12 of the container, which neck must thus be made out of a material that is transparent or translucent to the radiation from the source. By way of example, illuminating the neck 12 may serve to illuminate the remainder of the container. Provision may also be made for the fastener ring 3 to be made out of a material that is transparent or translucent to the radiation from the source 51: it is thus possible to illuminate at least a fraction of the pusher 4. In other words, the radiation emitted by the source 51 may have the effect of lighting one or more component elements of the dispenser and/or of treating the fluid dispensed by the dispenser.

In a practical embodiment, the source of radiation may be an LED 51 associated with a power-supply battery 52 and possibly with an electronic control circuit 53. Instead of an LED that emits visible light, it is also possible to use an LED that emits ultra violet (UV) light, for example. By way of example, the source may be switched on and off by actuating the pusher 4, or even by removing and repositioning a cap that is used to cover the pusher 4 and/or the fastener ring 3. The source of radiation 51, its battery 52, and its electronic circuit 53 may be mounted in the collar 5 that presents a cylindrical configuration. Thus, the collar 5 may be engaged around the neck 12, above the shoulder 11, as shown in FIG. 1.

The collar 5 is disposed below the fastener ring 3 to which it may be connected or with which it may even be made as a single part. In a practical embodiment, the collar includes a support ring 54 on which there are mounted three LEDs 51 as sources of radiation. The support ring also receives a power-supply battery 52 and an electronic control circuit 53. The support ring 54 is also provided with three small tabs 54' having a function that is described below. The collar 5 also includes a sleeve 55 that is generally cylindrical and that is engaged around the bottom portion of the neck 12. At its bottom end, the sleeve 55 is provided with a snap-fastener profile 57 for fastening the support ring 54. At its top end, the sleeve also includes connection or engagement means for connecting or engaging with the fastener ring 3, and more particularly with the skirt 33. In FIG. 1, it can clearly be seen that the engagement profiles 56 come into engagement on the outside of the skirt 33. By way of example, the engagement profiles 56 may snap-fasten with the skirt. The collar 5 also includes an outer fairing 58 that comprises a substantially-cylindrical section and an inwardly-directed top annular disk. The fairing 58 surrounds the ring 54 and the sleeve 55. Advantageously, the fairing 58 is made integrally with the sleeve 55. They co-operate with each other to form an annular U-shaped housing that opens downwards. The support ring 54 may be engaged in the housing and snap-fastened with the snap-fastener profile 57. The three tabs 54' come into abutment against the inwardly-directed rim of the fairing 58. This can clearly be seen in FIG. 1. The ring 54, the sleeve 55, and/or the fairing 58 may be made out of a material that is transparent or translucent to the radiation from the LEDs 51. The LEDs 51 may be oriented in such a manner as to radiate towards the neck 12 and the body 21 of the dispenser member 2, towards the fastener ring 3, towards the reservoir 1, or even towards the fairing 58. The component elements may thus be made out of a material that is transparent or translucent to the radiation from the LEDs 51. In a variant or in addition, a mirror layer may be applied to at least a fraction of the inside wall of the ring 54, of the sleeve 55, and/or of the fairing 58, so as to reflect the light emitted by the source 51 towards a determined location. By way of example, it is possible to deposit a mirror layer by silver plating the inside of the fairing 58 so as to prevent beams from passing to the outside, and to concentrate them towards the inside of the dispenser.

Although not shown, actuating or merely touching the pusher 4 may be used to switch the LEDs 51 on and off. Removing and repositioning a cap on the pusher and the ring may also serve to switch the LEDs 51 off. Such a cap may come directly into contact with the collar 5. To this end, the LEDs 51 may also be used to illuminate such a protective cap.

Positioning the LEDs 51 around the neck just above the shoulder makes it possible to illuminate or to irradiate any portion of the dispenser, but without that changing its general structure.

What is claimed is:

1. A fluid dispenser comprising:

a fluid reservoir including a shoulder from which there extends a neck defining an opening; and a dispenser member including a body that is held in stationary manner in the opening of the reservoir by fastener means that include a fastener skirt that engages the neck, at least one source of radiation being disposed in the proximity of the neck, outside said neck, above the shoulder the fluid dispenser being characterized in that the source of radiation is mounted in a collar that extends around the neck, above the shoulder and below the fastener skirt; and wherein the collar comprises a support ring on which the source of radiation is mounted; an assembly sleeve supporting the ring and connected to the fastener means; and an outer fairing that surrounds the ring, the sleeve, and the source of radiation; the sleeve and the fairing being made as a single part.

2. A fluid dispenser according to claim 1, wherein the collar is secured to fastener means.

3. A fluid dispenser according to claim 1, wherein the fairing is transparent or translucent to the radiation from the source of radiation.

4. A fluid dispenser according to claim 1, wherein the source of radiation is disposed axially at the height of the neck.

5. A fluid dispenser according to claim 1, including a plurality of sources of radiation that are distributed around the neck.

6. A fluid dispenser according to claim 1, wherein the source of radiation comprises an LED that is associated with a power-supply battery and possibly with an electronic circuit.

7. A fluid dispenser according to claim 1, wherein the reservoir is transparent or translucent to the radiation from the source of radiation.

8. A fluid dispenser according to claim 1, wherein the fastener means and/or the dispenser member is/are transparent or translucent to the radiation from the source of radiation.

9. The fluid dispenser according to claim 1, wherein the dispenser member is a pump or a valve.

10. The fluid dispenser according to claim 2, wherein the collar is secured to fastener means by snap-fastening on the fastener skirt.

* * * * *